United States Patent [19]

Cadwell, Jr. et al.

[11] Patent Number: 4,860,420

[45] Date of Patent: Aug. 29, 1989

[54] METHOD OF FABRICATING A CLEAN ROOM FILTER BANK

[75] Inventors: George H. Cadwell, Jr., Blounts Creek; Joseph A. Wood, Greenville, both of N.C.

[73] Assignee: Flanders Filters, Inc., Washington, N.C.

[21] Appl. No.: 35,373

[22] Filed: Apr. 7, 1987

[51] Int. Cl.[4] ..... B21B 1/46

[52] U.S. Cl. ..... 29/157 R; 29/527.2; 29/530; 55/355; 55/483; 55/484

[58] Field of Search ..... 29/157 R, 469, 527.1, 29/530, 527.2; 52/484, 665; 55/355, 385 A, 483, 484, 494, 502, DIG. 29; 98/115 LH, 10 D, 415 V

[56] References Cited

U.S. PATENT DOCUMENTS 3,986,850 10/1976 Wilcox .
4,082,525 4/1978 Allan .
4,233,044 11/1980 Allan .
4,511,380 4/1985 Fetter .
4,545,793 10/1985 Shuler .
4,555,255 11/1985 Kissel .
4,570,391 2/1986 Quante et al. .
4,639,261 1/1987 Pittman et al. .
4,671,811 6/1987 Cadwell, Jr. et al. .
4,678,487 7/1987 Cadwell, Jr. et al. .

*Primary Examiner*—Timothy V. Eley
*Attorney, Agent, or Firm*—Bell, Seltzer, Park & Gibson

[57] ABSTRACT

A method of fabricating a clean room filter bank under essentially "clean" conditions is disclosed, and wherein the filter bank includes a supporting latticework composed of a plurality of interconnected channel members which define rectangular open areas, and a plurality of high efficiency air filters positioned on the supporting latticework. The channel members of the latticework include a self-healing gel sealant, and they are fabricated under clean room conditions and then packaged in a protective wrapping for storage or shipment. At the installation site, the channel members are assembled to form the latticework while the protective wrappings remain essentially in place, and the wrappings are removed only just prior to the assembly of the filters in the latticework. Thus the sealant of the channel members is protected from contamination, during manufacturing, shipment and storage, and also during the actual assembly of the filter bank.

11 Claims, 4 Drawing Sheets

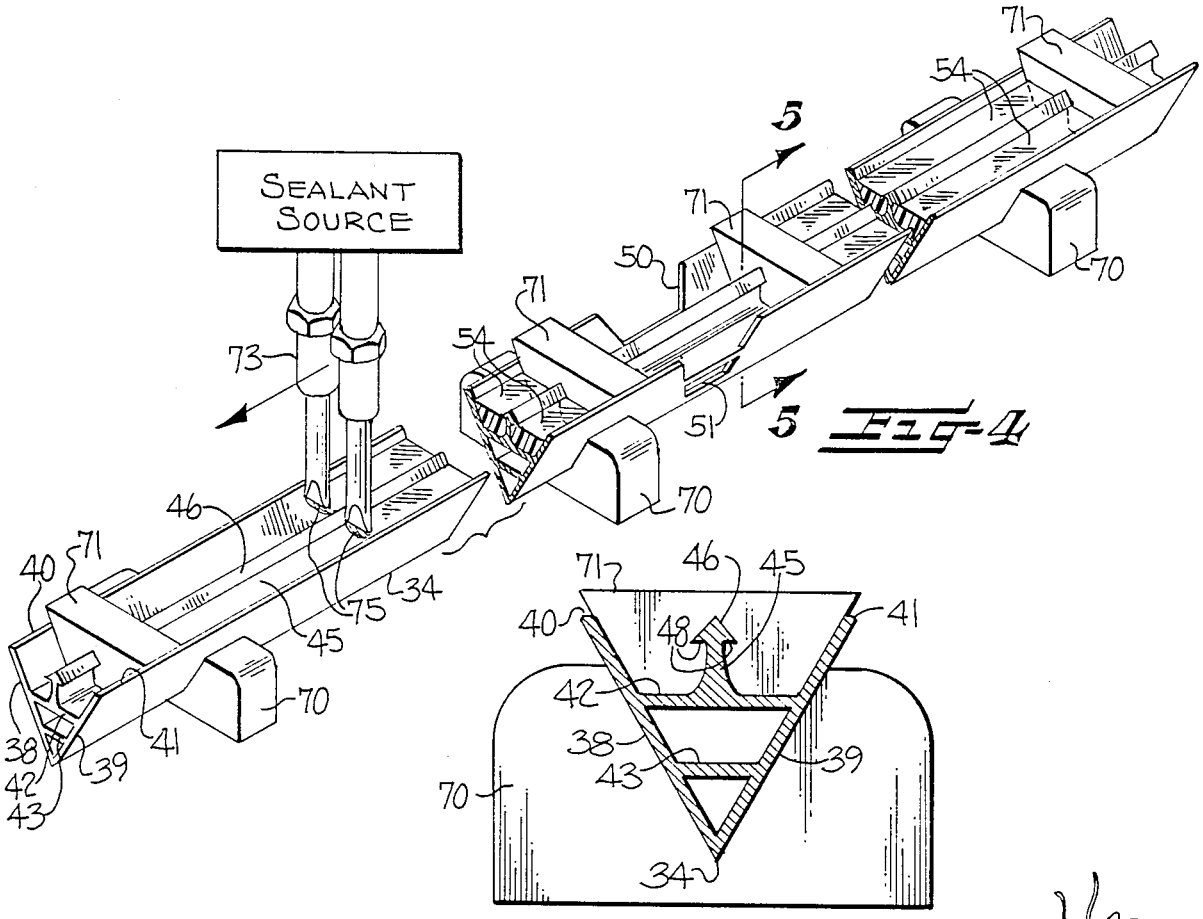
Fig-4
Fig-5
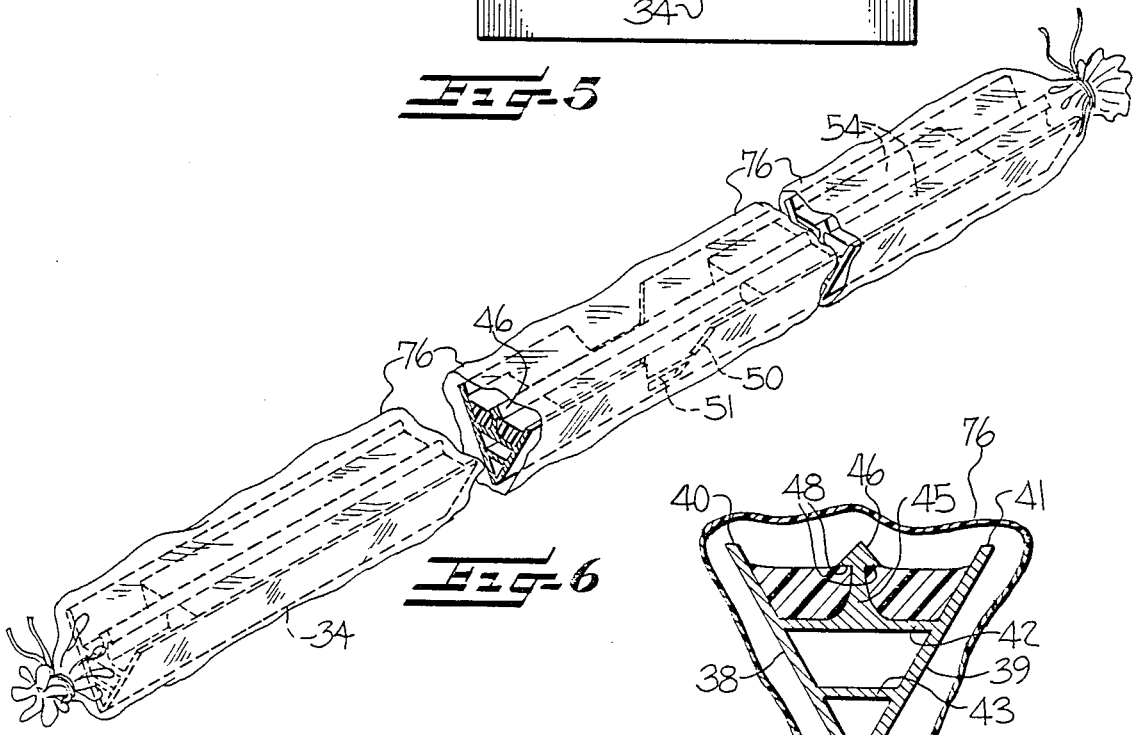
Fig-6
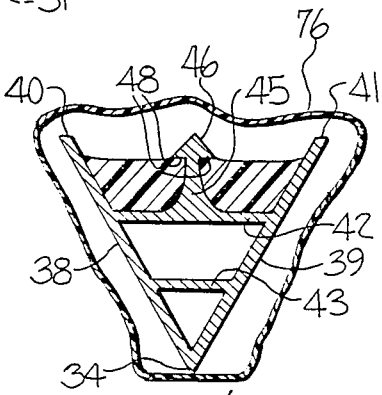
Fig-7

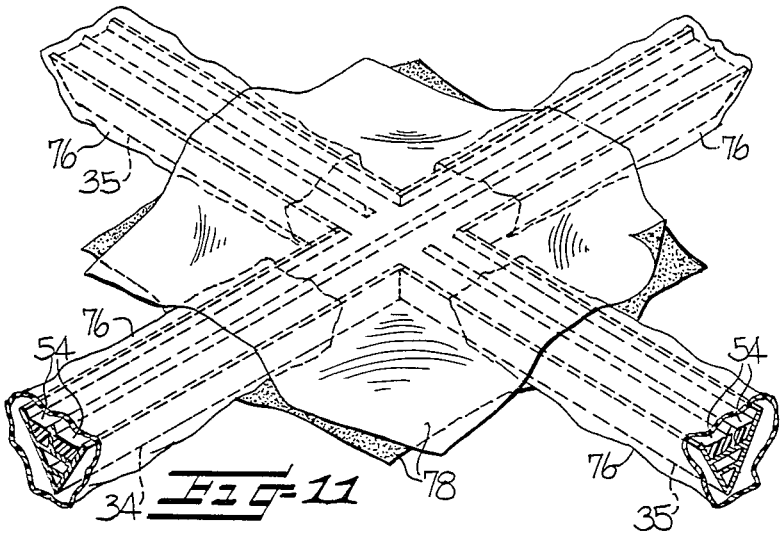
Fig-11
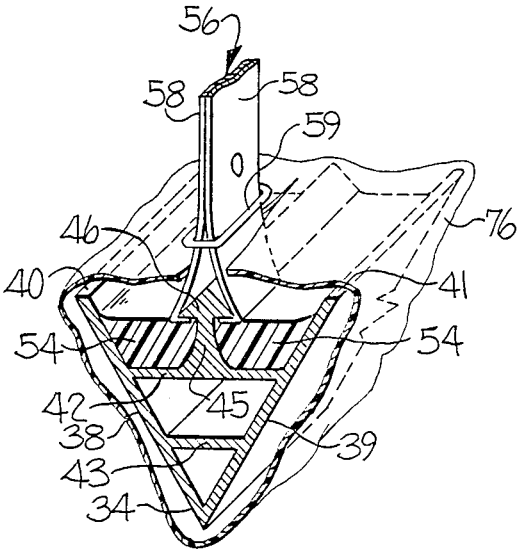
Fig-12
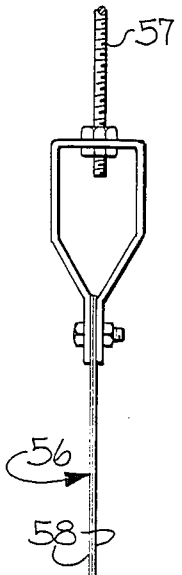
Fig-13
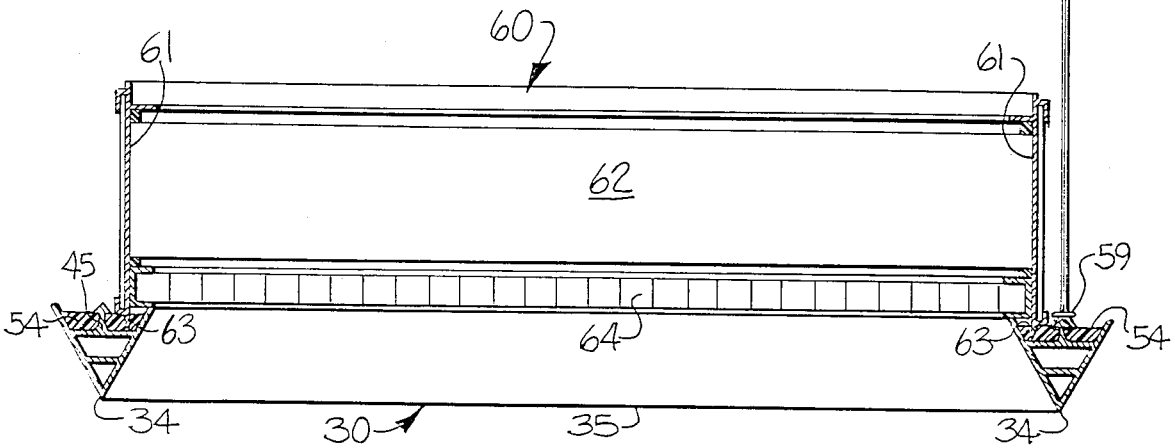

METHOD OF FABRICATING A CLEAN ROOM FILTER BANK

BACKGROUND OF THE INVENTION

The present invention relates to a method of fabricating a clean room filter bank, of the type adapted to supply highly filtered air to a work area under substantially laminer flow conditions, and wherein the components of the filter bank are maintained in a contaminant free condition during their manufacture, storage, shipment, and final assembly at the clean room site.

The need for a controlled, contaminate free work area is well recognized in industry wherever precision manufacturing and assembly operations are conducted, and several clean room designs have been developed for this purpose. In one such prior design, the clean room comprises a room-like enclosure having a horizontal filter bank suspended from and overlying the entire ceiling. The filter bank includes a number of individual high efficiency filters supported on a rectangular latticework, and a blower introduces air under pressure into the open plenum chamber formed between the filter bank and ceiling. The air then passes downwardly through the filters and vertically through the clean room. Appropriate ducts are provided in or adjacent the floor for conveying the air back to the blower for recirculation.

Copending and commonly owned U.S. patent applications 733,971 and 733,972, now Pat. Nos. 4,671,811 and 4,678,487 respectively each disclose a clean room of the above design. In addition, these copending applications disclose a supporting horizontal latticework composed of a plurality of interconnected channel members arranged in a rectangular pattern so as to define rectangular open areas. The channel members have the configuration of an inverted A in cross section, and so that the channel members define an upwardly open receptacle. A gum-like sealant is disposed in the receptacles after the complete assembly of the latticework, so that a continuous uninterrupted strip of sealant extends about the periphery of each open area. As a final step in the fabrication of the filter bank, the filters are positioned to overlie the open areas, and the filters include peripheral skirts which are embedded in the sealant to seal the filters to the latticework.

While the above disclosed clean room design has achieved widespread acceptance in the industry, the installation procedure remains time consuming and tedious, particularly with respect to the installation of the sealant into the receptacles of the channel members since the sealant installation takes place after assembly of the latticework and adjacent the ceiling of the clean room. In addition, the fabrication of the latticework can result in dust and debris being caught in the receptacles and the sealant, and this foreign matter can interfere with the seal of the filters, and it can also become dislodged during subsequent use of the clean room so as to cause contamination of the sensitive products in the room.

It is accordingly an object of the present invention to provide a method of fabricating a clean room filter bank which effectively alleviates the above problems and limitations in the prior art.

It is a more particular object of the present invention to provide a method of fabricating a clean room filter bank which protects the components of the supporting latticework from contamination by foreign materials, throughout the manufacturing process of the components, shipment and storage of the components, and also during the assembly of the components into a filter bank.

It is a further object of the present invention to provide a method of fabricating a clean room filter bank which significantly reduces the amount of the sealant which is deposited into the receptacles after the fabrication of the latticework, and so as to simplify the installation process.

It is still another object of the present invention to provide a channel member which is adapted to be fabricated into a supporting latticework for a clean room filter bank, and wherein the sealant can be assembled with the channel member under clean room conditions at the factory, with the clean conditions being preserved during shipment, storage, and final assembly of the channel member into the latticework of the filter bank.

SUMMARY OF THE INVENTION

The above and other objects and advantages of the present invention are achieved in the embodiment illustrated herein by the provision of a method of fabricating a horizontal latticework for a filter bank, and which includes the steps of providing a plurality of channel members, with each member comprising a pair of longitudinally extending outer side walls and a plate extending horizontally between the side walls, and so as to define at least one upwardly open receptacle between the side walls and plate. The receptacles of the channel members are substantially filled with a sealant at the factory, and prior to being shipped to the site of the clean room. In accordance with the preferred embodiment of the invention, the sealant is placed in the receptacles by initially placing an end dam in each receptacle of each of the channel members, and adjacent each of the ends thereof. A liquid is then deposited in the portion of each receptacle between the end dams, with the liquid being adapted to solidify to form a self-healing sealant. The liquid is then caused to soldify, and each of the channel members is then enclosed in a flexible plastic wrapping so as to avoid contamination of the sealant during subsequent shipment and storage. It is preferred that the channel members be maintained under clean room conditions during the sealant filling step and all subsequent steps until the members are sealed in the plastic wrappings, to further protect the members from contamination. It is also preferred that the end dams be removed from the channel members prior to being enclosed in the flexible plastic wrapping.

At the site of the clean room installation, openings are formed at selected locations in the enclosing plastic wrapping of each of the channel members, while the remaining portions of the wrapping of each channel member are maintained in position thereon. Next, the channel members are assembled into a rectangular open latticework so as to define a plurality of rectangular open areas, and the assembling operation includes joining portions of the channel members to each other, with the joined portions extending through the openings of the plastic wrappings of the channel members. An additional quantity of the same liquid is then deposited into the portions of each receptacle which were not previously filled, and after the solidification of this additional liquid, there results a continuous strip of the sealant about each of the open areas of the latticework. To complete the fabrication operation, the plastic wrappings are then removed from the channel members, and the filters installed so as to overlie each open area and so as to sealably engage the sealant about the entire periphery of the associated open area.

Also in the preferred embodiment, each of the channel members includes a post extending upwardly from the medial portion of the horizontal plate, and so that an upwardly open receptacle is formed on each side of the post. During the assembly of the channel members into the latticework, additional openings are formed at selected locations in the wrapping so as to permit a supporting hanger to engage the post of at least some of the channel members, and without significant disruption of the sealant in the two adjacent receptacles.

BRIEF DESCRIPTION OF THE DRAWINGS

Some of the objects and advantages of the present invention having been stated, others will appear as the description proceeds, when taken in conjunction with the accompanying drawings, in which

FIG. 4 is a somewhat schematic perspective view of the step of depositing a sealant forming liquid in the receptacles of a channel member;

FIG. 5 is an end view of the channel member as seen in FIG. 4;

FIG. 6 is a perspective view of the channel member shown in FIG. 4, and subsequent to being enclosed in a plastic wrapping;

FIG. 7 is a sectional end view of the channel member as seen in FIG. 6;

FIG. 11 is a fragmentary perspective view of one of the intersections of the latticework as shown in FIG. 9;

FIG. 12 is a fragmentary sectional view of one of the channel members and associated hanger as shown in FIG. 9; and FIG. 13 is a sectional view of a portion of the latticework and a supported filter of the filter bank shown in FIG. 1;

DETAILED DESCRIPTION OF THE PREFERRED EMBODIMENT

Figure 1:
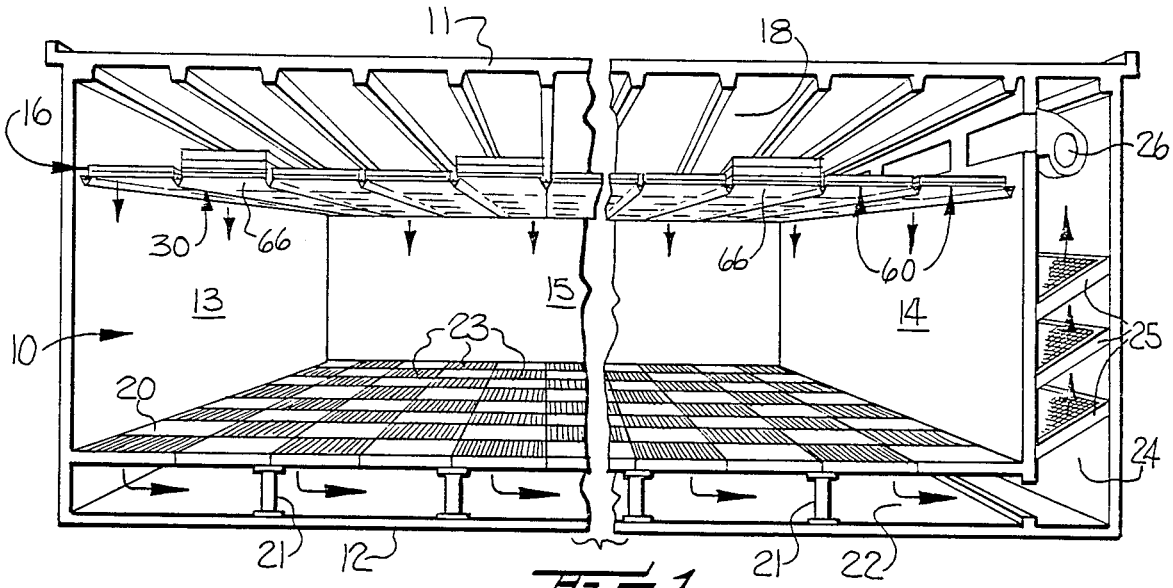
FIG. 1 is a sectional side elevation view of a clean room which is adapted to be fabricated in accordance with the method of the present invention.

Referring more specifically to the drawings, FIG. 1 illustrates a clean room 10 which is adapted to be fabricated in accordance with the method of the present invention. As illustrated, the clean room comprises an enclosure which includes a top wall 11, a bottom wall 12, two bounding side walls 13, 14, and a bounding end wall 15 (the opposite bounding end wall not being shown). A horizontally disposed filter bank 16 is positioned within the enclosure parallel to and spaced from the top wall 11, to define an open air supply plenum 18 therebetween. A raised floor 20 is mounted upon suitable pedestals 21 above the bottom wall 12 to define a return air plenum 22, the floor 20 including a number of perforated panels 23 for permitting air to pass therethrough. The return air plenum 22 communicates with a vertical duct 24 containing a number of pre-filters 25, and the vertical duct in turn communicates with the air handling unit for recirculating the air into the air supply plenum 18. Typically, the air handling unit comprises a number of blowers 26, and a heating or air conditioning apparatus. Thus in use, the air delivered to the air supply plenum 18 by the blowers 26 passes downwardly through the filter bank 16 such that substantially all contaminants are removed immediately before the air enters the room. The air then passes vertically downwardly through the room under substantially laminar flow conditions, and through the floor 20 to the return air plenum 22. The returning air passes through the pre-filters 25 where any relatively large particles in the air stream are removed, and through the blowers 26 to the air supply plenum 18.

The filter bank 16 has an area which is substantially coextensive with the area of the top wall 11, and comprises a horizontally disposed supporting latticework 30 which defines a plurality of rectangular open areas 31. The latticework 30 comprises a plurality of interconnected channel members, including lengthwise members 34 and relatively short cross members 35 which extend laterally between the lengthwise members. The members 34, 35 have a like cross sectional outline as best seen in FIG. 5, and more particularly, each member includes a pair of longitudinally extending outer side walls 38, 39 which define upper edges 40, 41 respectively and which are horizontally aligned. The side walls 38, 39 are disposed in a V-shaped arrangement, and an upper internal plate 42 extends horizontally between the side walls, and a lower internal plate 43 is disposed parallel to and below the plate 42. Thus each member 34, 35 may be said to have the general form of an inverted A in cross section.

The members 34, 35 also include an integral post 45 extending upwardly from a medial portion of the plate 42 and longitudinally along at least a substantial portion of the length of the member. The post 45 includes an upper portion 46 which is triangular in cross section, with the triangular upper portion 46 including a horizontal bottom surface 48 which is parallel to and spaced above the internal plate 42, and so that the post 45, outer side walls 38, 39, and internal plate 42 define an upwardly open receptacle on each side of the post 45 and between the post and the adjacent outer side wall of the member. Also, as best seen in FIG. 5, the bottom surface 48 of the post 45 is somewhat below the level of the upper edges 40, 41 of side walls 38, 39.

Figure 8:
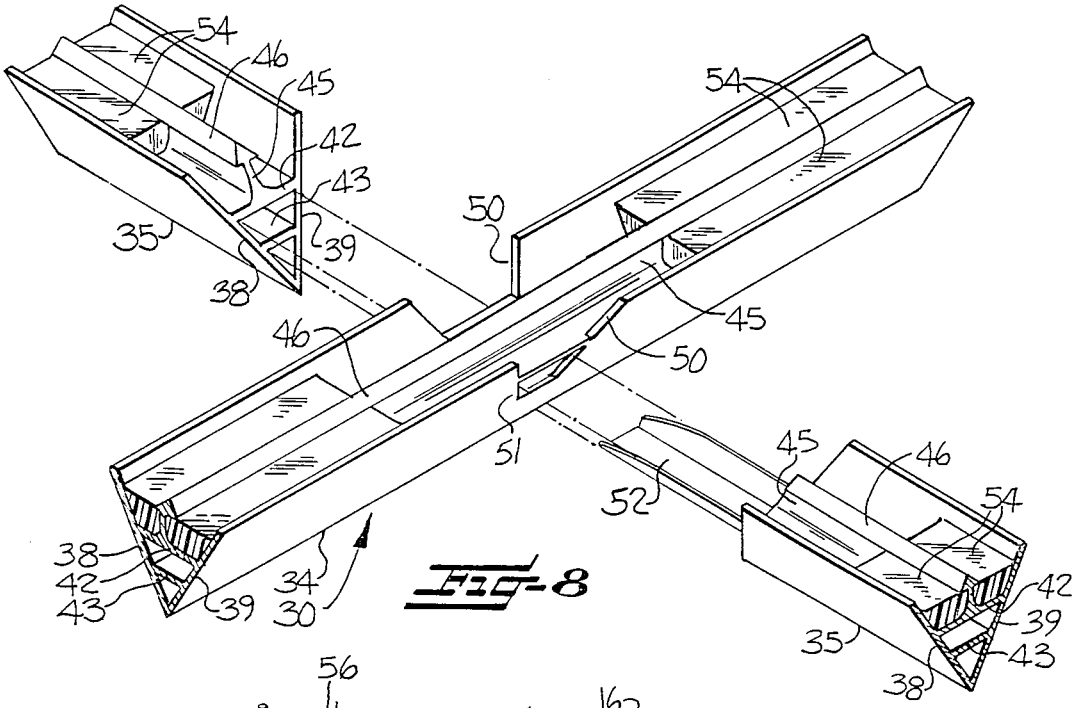
FIG. 8 is a fragmentary perspective and exploded view illustrating the manner in which the channel members are interconnected at right angles to each other to form the supporting latticework.
Figure 9:
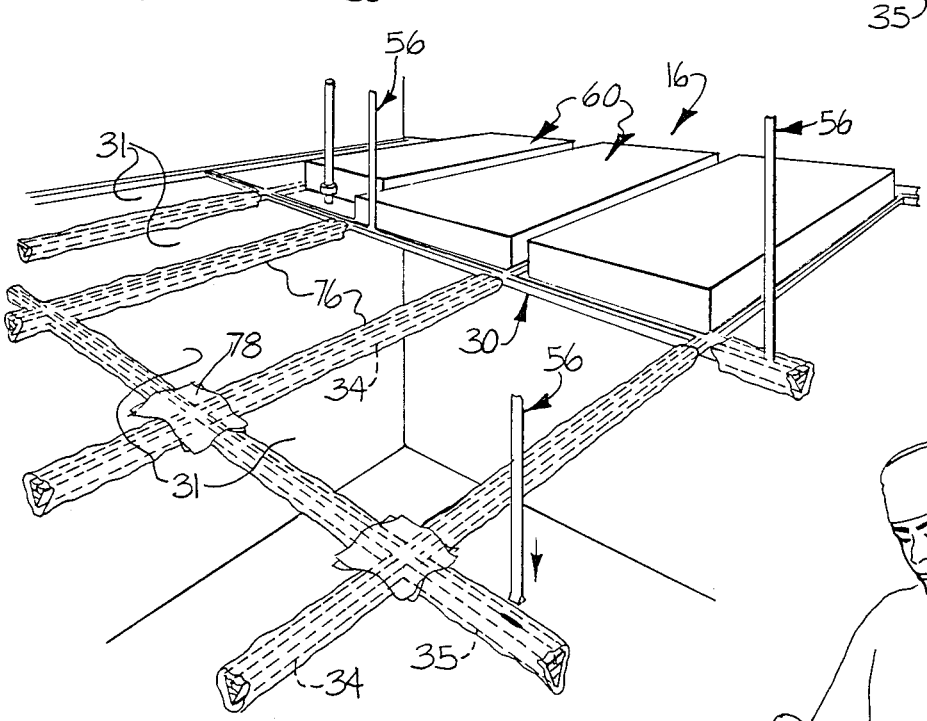
FIG. 9 is a fragmentary perspective view of a partially fabricated clean room filter bank in accordance with the present invention.

At each of the interconnections between the lengthwise members 34 and cross members 35, there is provided a cut out section 50 in each of the side walls of the lengthwise member 34, note FIG. 8, which extends downwardly to the level of the associated plate 42, and laterally a distance conforming to the separation of the adjacent portion of the side walls of the associated cross member 35. The interconnection also includes an elongate opening 51 through each of the side walls of the lengthwise member 34, and which communicates with the space formed between the upper plate 42 and lower plate 43. Also, each opening 51 is vertically aligned with the cut out sections 50 of the side walls. An elongate retainer 52 extends outwardly from the space between the upper and lower plates of one of the cross members 35 and then through the aligned openings 51 of the lengthwise member, and then into the space between the plates 42, 43 of the other cross member 35, to form a secure interconnection. At each such interconnection, the plates 42 of the lengthwise and cross members are substantially co-planar. Also, in the completed latticework, a sealant 54 is positioned upon the coextensive plates 42, and so as to extend continuously about the periphery of each open area of the latticework.

The latticework 30 is supported from the top wall 11 of the clean room, by a plurality of support hangers 56. More particularly, each support hanger 56 is connected to a threaded tie rod 57 (FIG. 13), which depends from the top wall 11, and which permits the elevation of the hanger to be adjusted. Each hanger also includes a pair of side-by-side flat arms 58, 58*a* (FIG. 12), which are free to separate laterally adjacent their lower ends, and which are shaped to form a triangular receptacle at their lower ends, and which is adapted to slide onto the triangular portion 46 of the post of the channel members, and snap below the bottom surface 48 of the post so as to lock in assembled condition. Each hanger also includes a lock ring 59 of rectangular outline, and which is adapted to slide downwardly after assembly to the post and so as to prevent the lateral separation of the arms 58, 58*a* and thus the release of the post.

A plurality of high efficiency particulate air filters 60 are positioned on the latticework 30, with one of the filters covering each of the open areas 31. Each filter 60 comprises a rectangular frame 61 and a filter pack 62 which is sealably disposed within the frame. The frame also includes a downwardly depending peripheral skirt 63 positioned about the outer periphery of the frame, and the skirt is adapted to rest within the receptacles of the associated channel members 34, 35 and to be sealably embedded in the sealant 54. Also, a protective plastic grill 64 may be mounted upon the channel members to cover each open area, and so that the grill is immediately below the downstream face of each filter. A filter of the described type is more particularly described in the U.S. Patent to Allen et al, No. 4,584,005.

Figure 2:
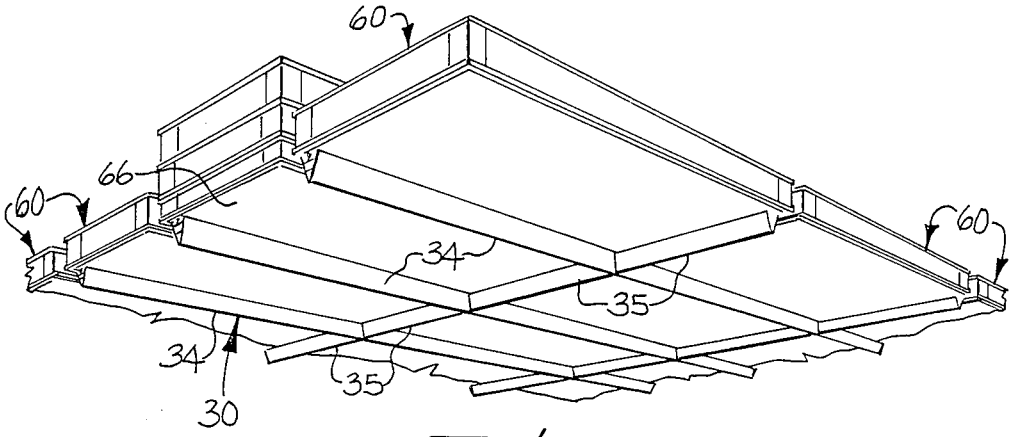
FIG. 2 is a fragmentary perspective view of a portion of the filter bank shown in FIG. 1.
Figure 3:
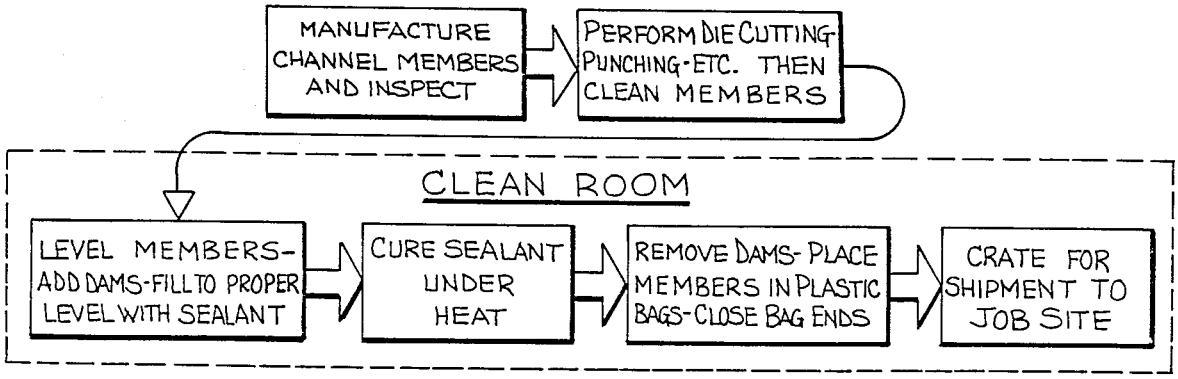
FIG. 3 is a flow diagram illustrating some of the steps of the method of the present invention.

A plurality of lighting fixtures 66 may be positioned in selected open areas of the latticework as seen in FIGS. 1 and 2. Each such lighting fixture includes a rectangular metal housing which includes a downwardly depending lower skirt which is sized to rest within the receptacles of the interconnected members of the latticework, and be embedded in the sealant in a manner similar to the skirts 63 of the filters.

FIGS. 3–12 illustrate a method of fabricating a filter bank of the type described above, and in accordance with the preferred embodiments of the present invention. More particularly, each of the channel members 34, 35 may be fabricated from a suitable metallic material by extrusion of the material into the indicated cross sectional configuration. The lengthwise channels 34 are then cut and punched so as to form the cut out sections 50 and side wall openings 51, and they are then carefully cleaned in a solvent bath to remove any cutting oil and other contaminants. Next, a number of the channel members are taken to a clean room of the same type as that illustrated in FIG. 1, where they are placed on a level table in supporting blocks 70. End dams 71, which typically comprise a resiliant rubber-like material, are positioned approximately 1 to 2 inches from each end of each channel member, and so as to close the ends of the associated receptacles. Also, end dams 51 are positioned on each side of the cut out sections 50 of the lengthwise channel members 34, as best seen in FIG. 4.

A two nozzle gun 73 is utilized to pump a liquid sealant forming material 75 into each of the two receptacles of each channel member, with the level of the liquid being controlled so that it just touches the bottom surface 48 of the post 45. Thus the bottom surface 48 serves as an indicator for the proper level of the sealant forming material. As seen in FIG. 4, the liquid is not deposited between the end dams on opposite sides of the cut out sections 50, and this portion of the receptacles remains unfilled, as do the portions adjacent each of the ends of the channel members.

The deposited liquid sealant forming material 75 preferably is a pourable material which cures and solidifies at room temperature to form a self-healing gel sealant 54. However, the curing may be expedited by the application of radiant heat, if desired. A particularly suitable material for forming the sealant is poly-dimethyl siloxane, and which when cured forms a resilient, self-healing and cohesive gel. The silicone base material sold by Dow Corning Corporation under the trade designation "sylgard 527" is also suitable and forms a similar gel upon curing.

After curing, the channel members 34, 35 are taken to a packaging area, which is preferably within the same clean room, and the end dams 71 are removed and a plastic tubular wrapping 76 is slipped over the entire length of each channel member. The ends are then closed, to provide a protective covering for each channel member. The channel members may then be crated for storage, or immediate shipment to the site of the clean room being fabricated.

At the clean room site, the channel members 34, 35 are assembled to form the latticework 30 in the manner generally described above. However, in accordance with the present invention, the plastic wrappings 76 remain in position on the channel members, except for openings which are formed along the members 34 at the cut out sections 50, and at the ends of the cross members 35, which are necessary to permit the joining of the members at the crossing intersections. Also, the intersections are preferably covered by a pair of self-adhering plastic sheets 78 in the manner illustrated in FIGS. 9 and 11, immediately after each intersection is fabricated, so as to maintain the intersections free of contamination during the remaining portion of the assembly process. Also, small slits are formed in the wrappings 76 to permit the hangers 56 to pass therethrough and engage and lock onto the posts 45. By this procedure, essentially the entire surface of the sealant and the open portions of the receptacles at the intersections are protectively covered during essentially all of the assembly of the latticework, to thereby preclude foreign materials from contaminating the sealant and open portions.

Figure 10:
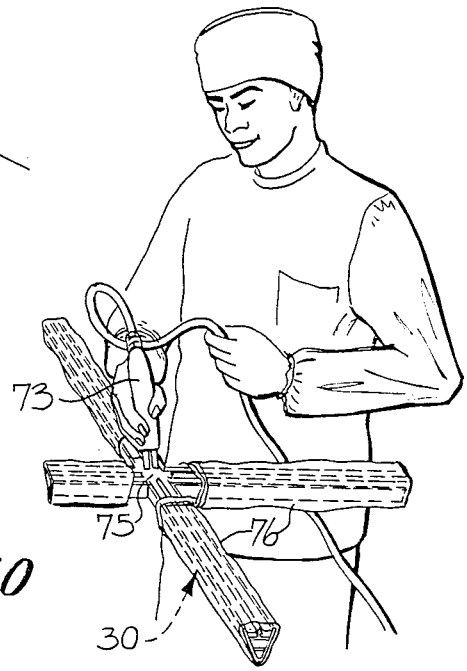
FIG. 10 is a fragmentary perspective view illustrating the step of depositing an additional quantity of the sealant forming liquid in the channel members after being assembled into a supporting latticework.

Once the entire latticework 30 is assembled, the technician sequentially peels apart the protective sheets 78 overlying the intersections, and paints a fast drying sealant on the joints to seal the cracks, and then deposits a small amount of the same sealant forming liquid 75 into the open portions of the receptacles, note FIG. 10. The overlying sheets 78 are replaced immediately after the deposit of the liquid, and the deposited liquid is permitted to cure and solidify, so as to form a continuous strip of the self-healing gel sealant 54 about the entire periphery of each open area 32 of the latticework.

As a final step, the protective sheets 78 and the plastic wrappings 76 are entirely removed from the channel members, and the filters 60 are installed so as to overlie each open area of the supporting latticework, and with the skirt 63 of each filter being sealably embedded in the sealant about the entire periphery of the associated open area. In this regard, the filters are also preferably packaged in protective plastic bags, which are removed as the filters are installed. Also, it is preferred that the protective sheets 78 and plastic wrappings 76 be removed from the channel members progressively as the installation of the filters proceeds, so as to further minimize the time in which the sealant is exposed before the skirt of the filter is embedded therein.

In the drawings and specification, there has been set forth a preferred embodiment of the invention, and although specific terms are employed, they are used in a generic and descriptive sense only and not for purposes of limitation.

That which is claimed is:

1. A method of fabricating a horizontal latticework which is adapted to form a portion of a filter bank in a clean room, and which is characterized by the ability to protect a sealant from contamination during the manufacturing, shipment, storage and assembly operations, said method comprising the steps of providing a plurality of channel members, with each member comprising a pair of longitudinally extending outer side walls, a plate extending horizontally between said side walls, and a post extending upwardly from the medial portion of said plate and longitudinally along at least a substantial portion of the length thereof so that said post, outer side walls, and plate of each of said channel members define an upwardly open receptacle on each side of said post and between said post and the adjacent outer side wall, placing an end dam in each receptacle of each of said channel members, and adjacent each of the ends thereof, depositing a liquid which is adapted to solidify and form a self-healing sealant, in the portion of each receptacle of each of said channel members between the end dams thereof, causing the liquid in the receptacles of the channel members to solidify so as to form a self healing sealant, and enclosing each of the channel members in a flexible plastic wrapping so as to avoid contamination of said sealant during shipment and storage.

2. The method as defined in claim 1 comprising the further step of maintaining each of the provided channel members under clean room conditions during each of the steps of placing an end dam in each receptacle, depositing a liquid in each receptacle, causing the liquid to solidify, and enclosing each of the channel members in a flexible plastic wrapping.

3. The method as defined in claim 2 comprising the further subsequent step of fabricating the channel members into a rectangular horizontal latticework and which comprises forming openings at selected locations in the enclosing plastic wrapping of each of said channel members, while maintaining the remaining portions of the wrapping of each channel member in position thereon, and assembling the channel members into a rectangular horizontal latticework so as to define a plurality of rectangular open areas, and including joining portions of the channel members to each other and engaging the post of at least some of the channel members with a supporting depending hanger, and with the joined portions and hangers extending through said openings of said plastic wrappings of said channel members.

4. The method as defined in claim 3 comprising the further step of removing the end dams from the receptacles of each of said channel members subsequent to causing the liquid to solidify and form a sealant.

5. The method as defined in claim 4 comprising the further subsequent step of depositing an additional quantity of said liquid into the portions of each receptacle which were not previously filled, with such depositing of additional liquid being conducted subsequent to the step of assembling the channels into a latticework, and then causing such additional liquid to solidify, such that each of said open areas is bounded by a continuous strip of said sealant.

6. The method as defined in claim 5 comprising the further subsequent step of removing the plastic wrappings from the channel members, and installing a filter so as to overlie each open area of the supporting latticework, with each filter sealably engaging the sealant about the entire periphery of the associated open area.

7. The method as defined in claim 6 wherein said deposited liquid solidifies so as to form a silicone base resilient and self-healing gel.

8. A method of fabricating a horizontal filter bank in a clean room, and comprising the steps of providing a plurality of channel members, with each channel member comprising a pair of longitudinally extending outer side walls, and a plate extending horizontally between said side walls, and so as to define at least one upwardly open receptacle between said side walls and plate, placing an end dam in each receptacle of each of said channel members, and adjacent each of the ends thereof, depositing a liquid which is adapted to solidify and form a self-healing sealant, in the portion of each receptacle of each of said channel members between the end dams thereof, causing the liquid received in the receptacles of the channel members to solidify so as to form a self-healing sealant, removing the end dams from the receptacles of each of said channel members subsequent to the solidification of the sealant, fabricating the channel members into a rectangular horizontal latticework and so as to define a plurality of rectangular open areas, and including joining portions of the channel members to each other, and then depositing an additional quantity of said liquid into the areas of each receptacle which were not previously filled, with such depositing of additional liquid being conducted subsequent to the step of assembling the channels into a latticework, and causing such additional liquid to solidify, such that each of said open areas is bounded by a continuous strip of said sealant, and then installing a filter so as to overlie each open area of the supporting latticework, with each filter sealably engaging the sealant about the entire periphery of the associated open area.

9. The method as defined in claim 8 comprising the further step of enclosing each of the channel members in a flexible plastic wrapping subsequent to the initial depositing of a liquid in each of the receptacles and the solidification of such liquid, and so that the enclosing wrapping serves to avoid contamination of the sealant during subsequent shipment and storage of the channel members.

10. The method as defined in claim 9 wherein the step of fabricating the channel members into a rectangular horizontal latticework includes forming openings at selected locations in the enclosing plastic wrapping of each of the channel members, while maintaining the remaining portions of the wrapping of each channel member in position thereon, such that the joined portions of the channel members extend through the openings in said wrapping.

11. The method as defined in claim 10 wherein the step of installing a filter so as to overlie each open area of the supporting latticework includes removing the enclosing plastic wrapping from the channel members.

* * * * *